US011788245B2

(12) United States Patent
Timbrook et al.

(10) Patent No.: US 11,788,245 B2
(45) Date of Patent: Oct. 17, 2023

(54) POST HOLE BELLING AUGER

(71) Applicants: Joseph Timbrook, Monroe City, MO (US); Skyler Timbrook, Monroe City, MO (US); Saylor Timbrook, Monroe City, MO (US)

(72) Inventors: Joseph Timbrook, Monroe City, MO (US); Skyler Timbrook, Monroe City, MO (US); Saylor Timbrook, Monroe City, MO (US)

(73) Assignee: Jess Tools, Inc., Hunnewell, MO (US)

( * ) Notice: Subject to any disclaimer, the term of this patent is extended or adjusted under 35 U.S.C. 154(b) by 17 days.

(21) Appl. No.: 17/381,168

(22) Filed: Jul. 20, 2021

(65) Prior Publication Data

US 2022/0049556 A1 Feb. 17, 2022

Related U.S. Application Data

(60) Provisional application No. 63/054,041, filed on Jul. 20, 2020.

(51) Int. Cl.

| | |
|---|---|
| ***E02D 5/44*** | (2006.01) |
| ***E21B 10/32*** | (2006.01) |
| ***E21B 4/18*** | (2006.01) |
| *E02D 5/46* | (2006.01) |

(52) U.S. Cl.

CPC ..... *E02D 5/44* (2013.01); *E21B 4/18* (2013.01); *E21B 10/32* (2013.01); *E21B 10/327* (2013.01); *E02D 5/46* (2013.01)

(58) Field of Classification Search

CPC .... E02D 5/44; E02D 7/02; E02D 7/06; E02D 7/22

USPC ..... 405/237, 238

See application file for complete search history.

(56) References Cited

U.S. PATENT DOCUMENTS 1,779,643 A * 10/1930 Schwiers, Jr. ..... E21B 10/32 173/171
1,970,063 A * 8/1934 Steinman ..... E21B 7/28 175/391
3,112,802 A * 12/1963 Gustav ..... E21B 10/32 175/263
3,191,390 A * 6/1965 Schutte ..... E02D 5/38 405/238
3,343,614 A * 9/1967 Parisien ..... E21B 7/30 175/19
4,015,433 A * 4/1977 Shibata ..... E02D 5/54 405/259.5
4,547,106 A * 10/1985 Lipsker ..... E02D 5/803 405/262

(Continued)

FOREIGN PATENT DOCUMENTS

CN 104763328 A * 7/2015 ..... E02D 5/44
CN 105804061 A * 7/2016

(Continued)

*Primary Examiner* — Frederick L Lagman
(74) *Attorney, Agent, or Firm* — Brevetto Law Group

(57) ABSTRACT

A belling auger includes a rotatable shaft, a main shaft extending through the rotatable shaft, a sliding sleeve mounted on the main shaft a bottom panel and a shovel rotatably attached to the rotatable shaft. Pressing the rotatable shaft down towards the sliding sleeve causes the shovel to hinge outward at the bottom of a piling hole. As the device rotates the shovel scoops dirt onto the pan, thus widening the bottom of the hole to a bell or cone shape.

16 Claims, 9 Drawing Sheets

(56) References Cited

U.S. PATENT DOCUMENTS

| | | | | | |
|---|---|---|---|---|---|
| 4,843,785 | A * | 7/1989 | Sero | E02D 5/72 | 52/741.15 |
| 6,685,398 | B1 * | 2/2004 | Gunther | E02D 3/126 | 405/269 |
| 6,854,536 | B2 * | 2/2005 | England | E02D 5/44 | 175/311 |
| 7,621,098 | B2 * | 11/2009 | Reinert, Sr. | E02D 5/803 | 52/742.1 |

FOREIGN PATENT DOCUMENTS

| | | | | |
|---|---|---|---|---|
| GB | 2394489 | A * | 4/2004 | E02D 5/44 |
| KR | 850008512 | A * | 12/1985 | |
| KR | 20090110399 | A * | 10/2009 | |

* cited by examiner

Cutting edge views taken along line A—A' of FIG. 5.

POST HOLE BELLING AUGER

CROSS-REFERENCE TO RELATED APPLICATIONS

This application claims the benefit of and priority to Provisional U.S. Patent Application 63/054,041 filed Jul. 20, 2020 which is incorporated herein by reference in its entirety.

BACKGROUND

Technical Field

Various embodiments of the present invention relate to the construction industry, and more specifically, to equipment and methods of drilling holes for pilings, pylons, anchored posts, or the like.

Description of Related Art

Foundation pilings have been used to anchor buildings, bridges and other structures for thousands of years. The use of foundation pilings—sometimes called piles—serves to support and stabilize a structure built on top of the piling. Foundation pilings often consist of concrete poured into a cylindrical hole and reinforced with rebar 103. The concrete foundation piling generally has a top surface suitable for supporting the building, bridge or other structure. A piling may also have a building timber or post 101 set within the concrete that extends above the ground as part of the structure.

Conventional construction methods involve drilling a cylindrical piling hole in the ground which defines the outside diameter of the foundation piling. Workers generally put rebar 103 into the piling hole before pouring the wet concrete. Bolts or other anchoring hardware may be pressed down into the top surface of the concrete piling before it dries. Once the concrete has dried and hardened it is ready for a bridge, building or other structure to be built on top of it. An anchored construction timber or post 101 may be set within the piling hole before the concrete is poured. This method involves drilling a piling hole somewhat larger than the post or timber, and then filing space around the post or timber with wet concrete or other fill material to set the piling in place.

The weight of the structure expected to sit on the foundation piling determines the required pad width $CH_{PW}$ at the bottom of the hole. Since conventional piling holes are cylindrical the conventional hole shaft width $CH_{SW}$ is the same as the pad width $CH_{PW}$ at the bottom of the hole.

SUMMARY

The present inventors recognized certain drawbacks in the conventional ways of setting pilings in the ground. The novel new apparatus and methods of creating belled piling holes disclosed in the ensuing pages overcome these drawbacks and provides certain benefits and advantages not realized in the prior art.

Further to the invention of apparatus and methods of creating belled piling holes the present inventors have done considerable research in perfecting and improving their invention, details of which are disclosed in the ensuing pages.

BRIEF DESCRIPTION OF THE DRAWINGS

The accompanying drawings, which are incorporated in and constitute part of the specification, illustrate various aspects of the invention. Together with the general description, the drawings serve to explain the principles of the invention. In the drawings.

DETAILED DESCRIPTION

Figure 1A:
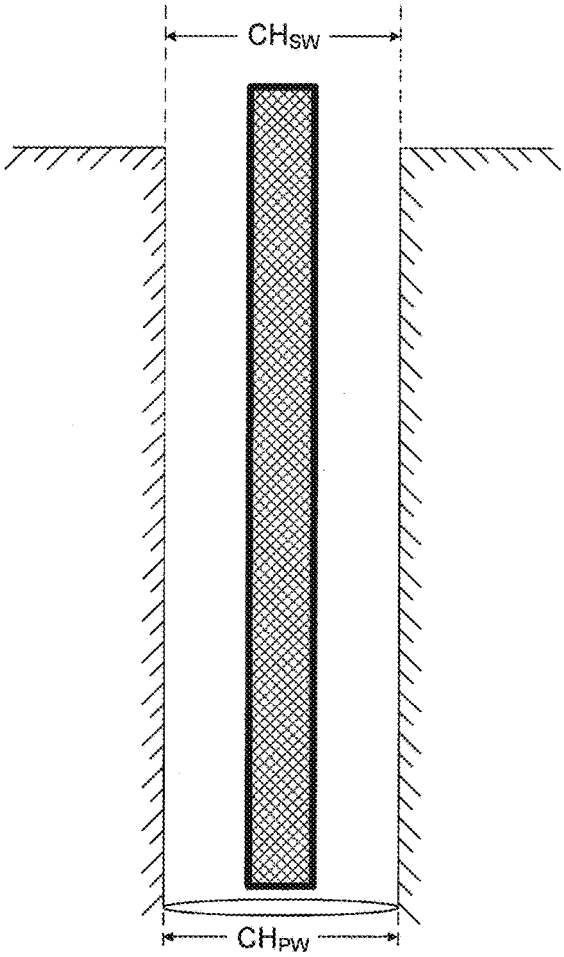
FIG. 1A PRIOR ART
FIGS. 1A-B depict convention piling holes.
Figure 1B:
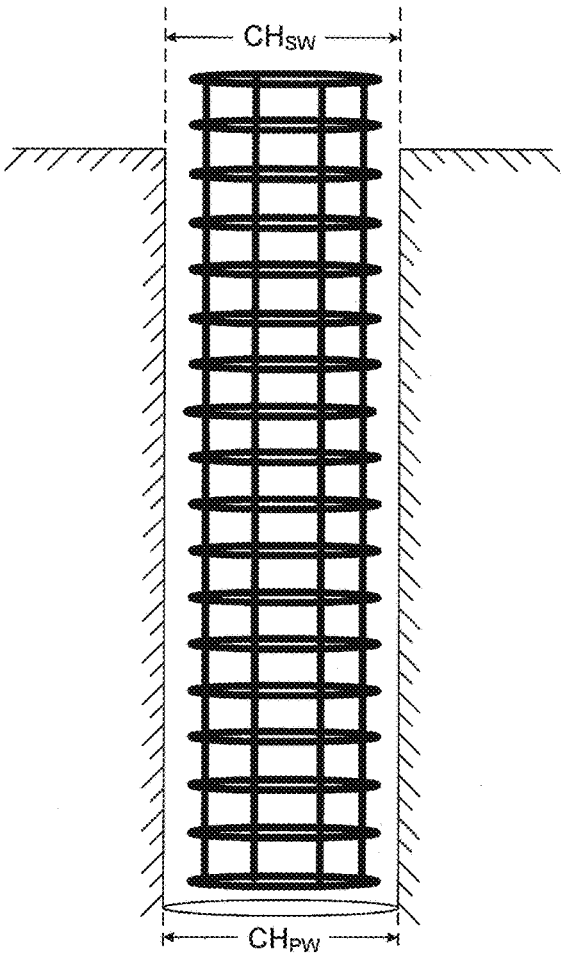
FIG. 1B PRIOR ART

The present inventors noticed that, in cold weather regions conventional foundation pilings tend to creep upward over time. The present inventors recognized that freezing and thawing the pilings a number of times causes them to slowing work upward in the ground over time. During the cold winter months the foundation pilings shrink slightly in both length and diameter. The slightly smaller diameter lessens their grip on the earth within the piling hole. The shortened length pulls the piling up slightly within the hole. Then when the pilings are heated up again in the summer and expand to their full size the sides of the pilings again grip the side of the piling hole, serving to push the piling slightly upward above its original position. After going through a number of winter freezes and summer thaws the foundation pilings may raise a half inch or more out of the ground. The gradual upward movement can degrade the structural integrity of the structure built upon the foundation pilings. This causes all sorts of problems for the structures that are built upon the foundation pilings. Doors and windows may start sticking, joints can become loosened, and cracks often appear in the walls and floors near the pilings. The present inventors developed an improved design for piling holes that overcomes these problems, in addition to providing other advantages and benefits.

The belling auger disclosed herein carves out the side walls at the bottom of a piling hole to provide a larger footprint for the foundation piling. The bell shaped or cone shaped anchor pad affords several advantages. First, belling the bottom of the piling hole helps to prevent the piling from slowly working its way up the hole as it freezes in the winter and heats up in the summer over a number of years. Second, belling the piling holes saves money on materials due to less concrete being required to fill them up. A third advantage involves the building codes that require pilings to sit on a certain width pad at the bottom of the hole. Using conventional technology the drilled holes are cylindrical to achieve the required pad width. But through the use of the belling auger disclosed herein a hole can be provided with a narrow shaft that extends downward to a wider belled pad at the bottom of the hole. Thus, less concrete is needed to fill the foundation piling for a given pad width. This saves construction time as well as material costs since fewer truckloads of concrete will need to be hauled and poured at the construction site.

The present inventors initially developed a single-shovel prototype belling auger for capable of belling post holes. After considerable experimentation the present inventors developed a number of design improvements on their single-shovel prototype, as well as inventing a double-shovel belling auger that enhances the operation of belling a post hole. Among the improvements over the original prototype the dual-shovel design is significant inasmuch as it produces a more balanced stabilized cutting stroke, as well as improved loading of cut dirt into the base pan of the belling auger. Moreover, a larger sized scoop was developed that improves dirt loading and removal from the hole. As the various bell auger characteristics were researched and improved the time and effort required to bell a hole and remove the dirt decreased dramatically. The design of the bell auger was refined to produce an optimal shaped bell hole with sides slanting at 45°+/_10° as compared to the up-down direction. The size, strength and leverage of the components was improved to increase durability and longevity of the unit. The criticality of the blade angle was discovered to efficiently cut into the soil side walls as the bell auger is widened to its fully extended position (sometimes called the open position). It should be noted that, while a dual-shovel belling auger is discussed herein to illustrate various embodiments, the present invention is not limited to having only two shovels. Some embodiments may have three shovels, four shovels, or more, depending upon the requirements of the implementation and the characteristics of the dirt to be removed.

A wide range of bell auger sizes were developed, including the following standard sizes: 9" (expanding outward to an 18" pad width); 12" (expanding to 24"); 18" (expanding to 36"); 24" (expanding to 48"); 36" (expanding to 72"); 48" (expanding to 96"). Larger sizes and customs sizes (in between those listed above) may be tailored to the particular requirements of a job site or client need. In developing and testing the different sized bell augers the present inventors discovered that certain aspects of the bell auger do not scale up linearly as the size of the bell auger increases. The inventors discovered that changes in various parameters and dimensions will produce optimal operation and results in different sized augers rather than simply scaling the dimensions upward or downward linearly. That is, the different sized bell augers do not operate efficiently if the various dimensions and parameters are simply scaled up or scaled down. For example, the different sized belling augers may be optimized by varying the cutting edge size, shape, length, angle of cut, degree, pitch or other parameters. Different sized bell augers operate most efficiently if the dimensions of parts and parameters are tailored for the hole size. Through experimentation the various sized bell augers were optimized for each hole size. Moreover, many factors were discovered that come into play in the design optimization of bell augers. Such factors include soil types (e.g., sandy soil, clay, loose soil, tightly packed soil), soil moisture content (e.g., dry, hard soil versus extreme wet conditions that makes soil unloading of mud much more difficult than dry soil). One final advantage occurs as a result of the belling auger being lowered to the bottom of the hole and then forced downward to extend the shovel outward and into the dirt sidewalls. Forcing the belling auger downward in the hole tends to compress the bottom of the hole. Compacting the dirt at the bottom of the hole creates a more structurally sound base for the piling member and/or concrete poured into the hole.

The present inventors also discovered the importance of the component dimension as they affect the downward force required to be applied by the power unit in order to open the bell auger during belling operations. The optimized design allows various embodiments of the bell auger to be used with either small or large power unit equipment. Improvements were made possible by varying the angle of arms that push scoops outward to start the cutting action. Finally, it was discovered that the larger diameter bell augers (e.g., 24" and above) operate more efficiently if used with a roller base plate in conjunction with stabilizing spikes. This helps to considerably reduce the torque required to drive the bell auger, thus allowing smaller vehicles to be used to drill larger holes. In addition to supporting more weight than the area of a conventional cylindrical hole, the widened bell auger pad also resists the post from pulling up out of the ground due to freezing and thawing or other upward forces.

Figure 2A:
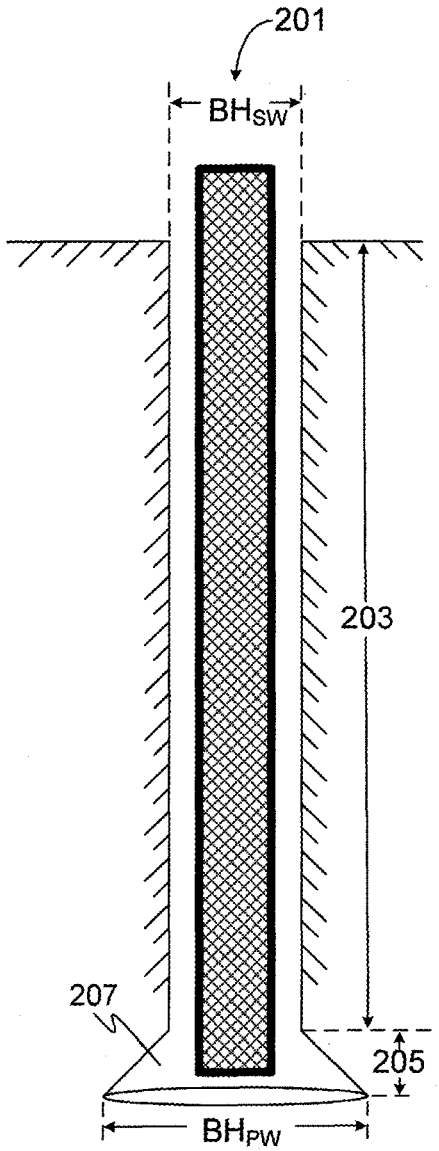
FIGS. 2A-B depict piling holes formed using a belling auger according to various embodiments.
Figure 2B:
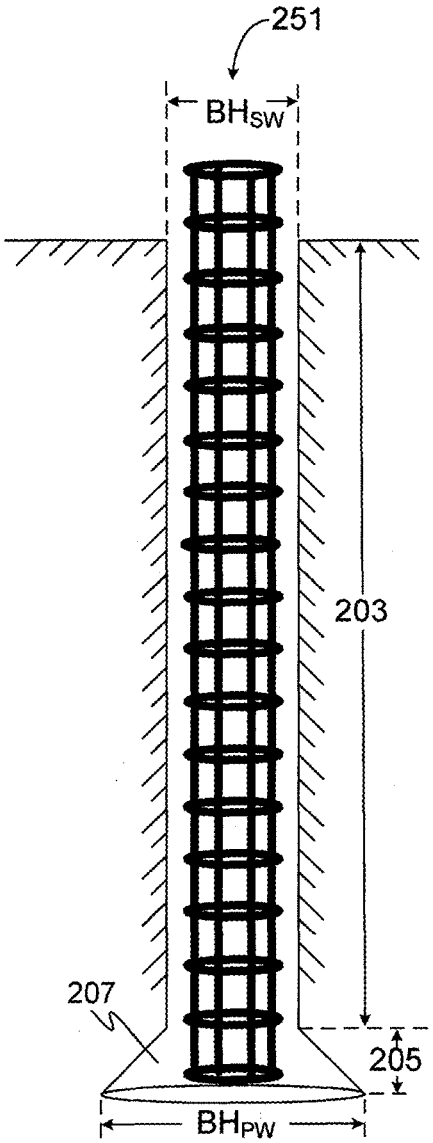

FIGS. 2A-B depict piling holes 201 and 251 formed using a belling auger according to various embodiments. As discussed in the ensuing paragraphs a belling auger according to various embodiments widens the bottom portion 205 of a cylindrical hole 203, allowing a piling, a rebar structure or other type of construction member to sit on a broader base, sometimes called a belled pad 207 or simply pad 207 for short). The process of widening the bottom of a hole is called "belling" the hole. The piling hole 201 of FIG. 2A has a piling inserted in it (e.g., a wooden or steel pole or girder). The piling hole 251 of FIG. 2B has a rebar structure inserted in it to strengthen the concrete poured into the hole. The novel belled piling holes 201 and 251 have a cylindrical hole shaft 203 of width $BH_{SW}$ (Belled Hole Shaft Width) extending downward from the surface of the ground, and another belled (widened) portion 205 extending downward to the bottom of the hole. The bottom of the belled piling holes 201 and 251 are characterized by a width $BH_{PW}$ (Belled Hole Pad Width). The bottom, widened portion of piling holes 201/251—that is, the volume within the additional depth of the belled portion 20—is often called the pad 207 of the belled hole.

The depth of piling holes 201 and 251 depends upon the weight of the structure that's anticipated to sit on the pilings, and the solidity of the bottom of the piling holes 201/251. For example, if the structure is extremely heavy (e.g., a bridge or tall building) the holes 201/251 may extend downward until firm soil or bedrock is reached. If the structure isn't very heavy (e.g., a pole barn or utility pole) the holes 201/251 may extend downward just a few feet into the ground. In either case the bottom of the piling and concrete sits upon the bottom of piling hole 201/251—that is, the pad 207 which is the bottom of belled portion 205 of the depth of the hole. Thus, a greater surface area at the bottom of the hole tends to provide more support for the piling than a smaller surface area. Regardless of how deep the piling hole 201/251 is—whether shaft hole 203 is five feet deep or fifty feet deep—the shape of belled portion 205 remains the same for a given implementation and width of the tool used to create the belled portion 205. That is, making the cylindrical shaft hole 203 twice as deep does not result in the belled portion 205 being elongated by twice as much (or by any amount at all) or changing shape. However, in various embodiments the shape of the belled portion 205 of the hole may take different forms.

Comparing FIG. 1A to FIG. 2A it is clear that, for a given pad size (where $CH_{PW}=BH_{PW}$) the belled piling hole embodiment of FIG. 2A uses much less concrete than the conventional piling hole of FIG. 1A since the belled piling hole of FIG. 2A has a narrower shaft portion 203 reaching down from the ground level. The same holds true for the rebar reinforced concrete pilings of FIG. 2B as compared to FIG. 1B. The conventional cylindrical rebar reinforced concrete pilings of FIG. 2B use quite a bit more rebar as well. This adds considerable expense to the conventional pilings since the value of rebar in a rebar reinforced concrete piling is a significant portion of the total piling cost. This is significant inasmuch as the size of the piling for heavy structures (e.g., a bridge or tall building) is driven more by the width at the bottom of the hole that the piling sits upon than the width of the piling itself. Relatively slender pilings can be used to support heavy structures—so long as there is sufficient lateral support and support at the bottom of the hole as provided by the belled piling holes disclosed herein.

Figure 3A:
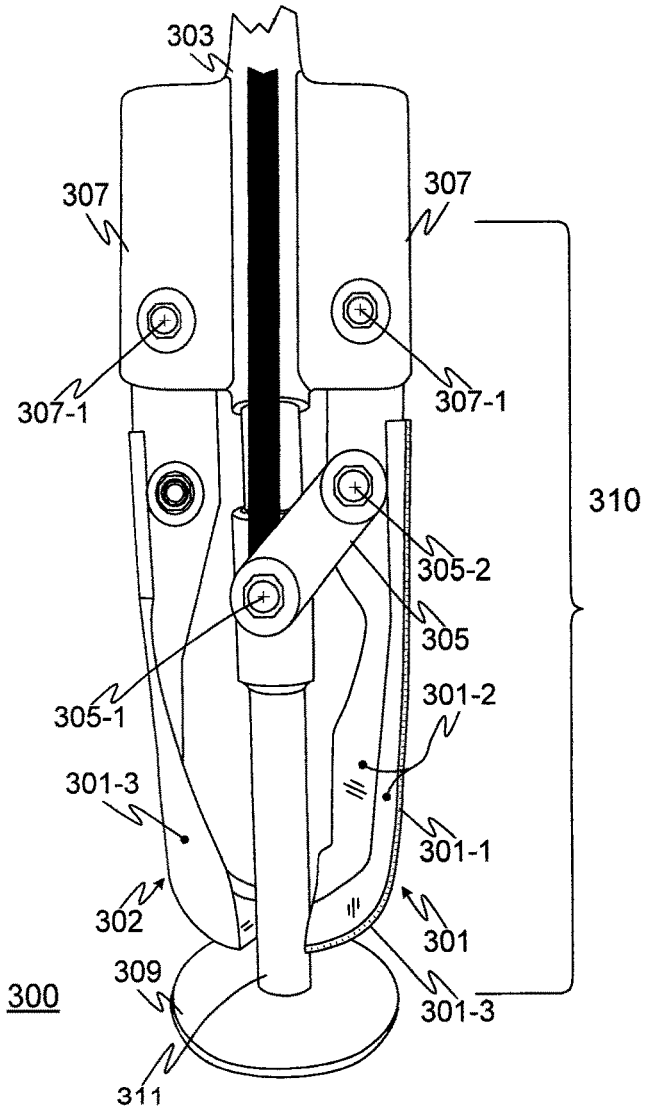
FIGS. 3A-C depict oblique views of a belling auger in the retracted position, according to various embodiments.
Figure 3B:
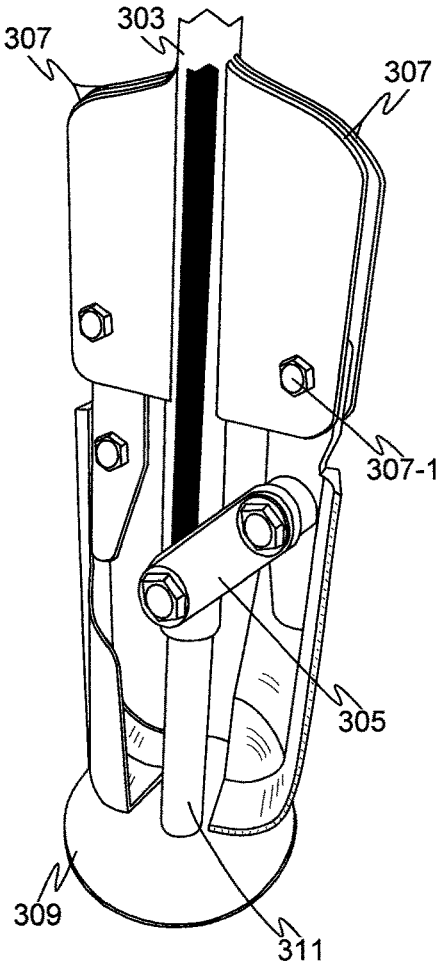
Figure 3C:
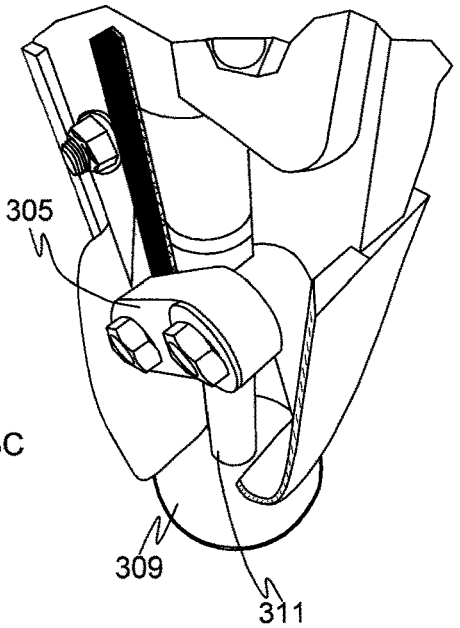

FIGS. 3A-C depict oblique views of a belling auger 300 in the retracted position (sometimes called the closed position), according to various embodiments. The figures depict the same belling auger 300 as viewed from different angles so as to illustrate various aspects of the design. As mentioned above, belling augers come in various sizes depending upon the size of the piling and requirements of the job. The various sized bell augers are typically referred to by the width of the shaft hole that extends from the earth's surface down to where the belling operation takes place (e.g., 9" hole, 12" hole, 24" hole, etc.). In other words, the size of a bell auger is referenced by the diameter of the cylindrical shaft hole 203 of the hole extending downward from the earth's surface. The cylindrical shaft hole 203 is typically drilled or dug using an auger to remove dirt from the hole. The belling auger 300 in its retracted position, as shown in FIGS. 3A-C fits into the cylindrical shaft hole 203 with sufficient clearance to be able to lower the belling auger 300 to the bottom of the hole, and then raise it up again (in the retracted position) once the belling operation has been completed—e.g., a typical sidewall clearance may be within the range of 0.5 inch to 3 inches, depending upon the size of the belling auger.

The belling auger 300 has a rotatable shaft 303 which lowers the belling assembly 310 down into the hole shaft to perform the belling operation. The shaft 303 may be made of iron or steel pipe or solid round stock, or may be made from any other suitably sturdy material as are known by those of ordinary skill in the art. The shaft 303 may be of sufficient length to reach to the bottom of the hole, or may include removable shaft components to accommodate various hole depths. A pair of tabs 307 is rigidly affixed to each side of the rotatable shaft 303. Some embodiments may use only a single tab 307 on each side. The belling assembly 310 includes the digging components of belling auger 300 that are attached to the pair of tabs 307 (or single tab) which is itself rigidly affixed to the rotatable shaft 303. In some implementations the belling assembly 310 may be affixed directly to the rotatable shaft 303 with a hinging mechanism. Such implementations are considered to be the mechanical equivalent to the various embodiments disclosed herein using the pair of tabs 307. Each shovel 301/302 is rotatably attached to a tab pivot point 307-1.

The top end of rotatable shaft 303 is attached to a source of rotational force (sometimes called source of torque). The source of rotational force rotates the rotatable shaft 303 with sufficient force to drive the belling auger around during the belling operation. Typically, the source of rotational force is capable of being raised and lowered in order raise and lower the belling auger in the hole, and provide the downward and upward force needed during the bell augering operations. The belling auger is not typically rotated while its being raised out of the hole or lowered into the hole. The rotational force (torque) and downward/upward forces required for belling operations are roughly the same such as those needed to auger (dig) the initial vertical hole shaft. The rotational force and downward/upward forces may be provided by a vehicle such as a skid steer that is typically of from 60 to 110 HP. Alternatively, other construction vehicles may be used to operate the belling auger including for example, a mini to mid sized excavator, a backhoe with a hydraulically powered rotational unit, or other such vehicle as are known by those of ordinary skill in the art. The source of rotational force can typically provide a variable rate of rotation—that is, the rate of rotation can be sped up or slowed down to accommodate the conditions of the soil or other materials the bell auger shovels are acting upon. The source of rotational force should be able to apply, at minimum, at least 100 foot-pounds of rotational force. In various embodiments the at least 200 foot-pounds of torque are needed. In other embodiments at least 500 foot-pounds of torque are needed.

Various embodiments of the belling auger have two shovel components 301 and 302—one on each side. The shovels 301/2 expand outward on opposite sides of the belling auger 300 at the same time while digging into the sides of the hole shaft. This helps to keep the belling assembly 310 in balance and maintain stability while the belling auger 300 rotates during the belling operation. The dual-shovel belling auger 300 has shovel 301 and shovel 302. The earliest belling auger prototypes were single-shovel belling augers. While it's possible to bell a hole using a single-shovel design, the dual-shovel belling auger tends to operate more efficiently since the digging forces on each side tend to balance each other out.

An extension strap 305 is rotatably attached to each shovel 301/2 at an outer strap pivot point 305-2. (The extension strap may also be called an expansion strap or a connection strap.) The other end of the extension strap 305 is rotatably attached to the belling assembly 310 at an inner strap pivot point 305-1 (sometimes called inner strap axis of rotation). The extension strap 305 pushes (or extends) the shovel 301 outward towards its extended position. A rotation pin (e.g., a bolt or other cylindrical member) serves as the inner strap pivot point 305-1. The inner strap pivot point 305-1 for both shovels 301/2 may lie on the same axis line. For such configurations the inner strap for each shovel pivots about the same rotational axis, although they rotate in opposite directions as the shovels 301/2 are extended outward or retracted inward. One rotates clockwise and the other rotates counterclockwise. In various embodiments the inner strap pivot point 305-1 is positioned lower than the outer strap pivot point 305-2, as shown in FIG. 3A (sometimes called outer strap axis of rotation). A rotation pin (e.g., a bolt or other cylindrical member) serves as the outer strap pivot point 305-2. Some embodiments feature dual extension straps for each shovel, with one extension strap on each side of the rotatable shaft 303 in order to balance the forces pressing against extension strap bolts (or pins) at the inner and outer strap pivot points 305-1/2. The two straps in each set dual extension straps are positioned in parallel and rotate about the same pivot axes; e.g., an axis extending through pivot point 305-2. The smaller sized belling auger embodiments (e.g., the 9" belling auger) may not have dual extension straps—instead, having only a single extension strap 305 for each shovel 301/2 as shown in FIGS. 3A-C. For smaller sized embodiments there simply isn't much space for the folding mechanism to fit within due to the small size of the piling hole. To save space, smaller embodiments of the belling auger may use a single extension strap 305 as shown in FIGS. 3A-C. The single extension strap 305 may be made from heavier materials than the materials used in dual extension strap embodiments. The heavier materials help to prevent twisting and bending of the mechanism due to the unbalanced forces applied to extension strap 301.

The belling assembly 310 includes a base pan 309 positioned below the inner strap pivot point 305-1. The base pan 309 rests on the bottom of the hole upon lowering the belling assembly 310 into the hole shaft. Typically, the base pan 309 made of very thick iron (or else has weight is added to it) to aid in retracting the shovels 301/2 from their extended position. The base pan 309 taken together with base shaft 311 typically weigh at least 15 pounds. In some various other embodiments the base pan 309 and base shaft 311 together weigh: 25 pounds or more, or 35 pounds or more, or 50 pounds or more, or 75 pounds or more.

The base shaft 311 is rigidly affixed to the center point of base pan 309. The base shaft 311 is in a fixed in position with respect to base pan 309. This ensures that the inner strap pivot point 305-1 remains fixed with respect to the base pan 309, and thus, the bottom of the hole. The shovels 301/302 are extended outward by applying downward force on the rotatable shaft 303. The rotatable shaft 303, via the tabs 307, applies downward force on the outer strap pivot points 305-2. Since the extension straps 305 are a fixed length, and since the inner strap pivot point 305-1 remains fixed with respect to the base pan 309, the downward force is translated into a rotational force applied to the extension straps 305. The extension straps 305 rotate downward pushing the shovels 301/2 outward. As the bottom of the rotatable shaft 303 gets closer to the base pan 309 due to the downward force being applied, the shovels 301/2 extend outward. While the downward force is being applied a rotational force is being applied to the rotatable shaft 303. This in turn rotates the shovels 301/2 about the tab pivot points 307-1 which causes the shovels 301/2 to cut into the sides of the hole as the belling assembly 310 rotates.

Various embodiments may include one or more stabilizing spikes extending downward from the bottom of base pan 309 (not shown in FIGS. 3A-C). The vertical position of the inner strap pivot 305-1 is fixed with respect to base pan 309. The vertical distance between the inner strap pivot 305-1 and the base pan 309 is a predefined fixed distance, and doesn't change during the belling operation. As base pan 309 comes to rest on the bottom of the hole shaft and doesn't move any further down, the inner strap pivot point 305-1 also comes to rest at a fixed position in the vertical direction and doesn't move any further down.

To begin the belling operation and carve dirt away from the walls at the bottom of the hole the belling auger 300 is lowered until the base pan 309 comes to rest on the bottom of the hole shaft. Downward force is applied to the rotatable shaft 303 while the belling assembly 310 is being rotated by, the source of rotational force; e.g., by a backhoe with a hydraulically powered rotational unit. The downward force pushes the outer strap pivot points 305-2 downward. However, the distance between each inner strap pivot point 305-1 and its corresponding outer strap pivot point 305-2 is fixed by the length of the extension strap 305. Thus, the inner strap pivot points 305-1 remain a fixed distance from the base pan 309 while the outer strap pivot points 305-2 are pushed downward. This causes the extension straps 305 to pivot around the inner strap pivot points 305-1, thus pushing the shovels 301/2 outward into the dirt walls of the hole. As the belling assembly 310 rotates and the shovels 301/2 cut into the sidewall dirt, the shape of the shovels 301/2 causes the loosened dirt to be thrown inward onto base pan 309.

Once the base pan 309 is full (or a sufficient amount of dirt has been dug) no more downward force is applied, and rotation of the rotatable shaft 303 and stopped. Upward force can be applied. The upward force causes the shovels 301/2 to pivot inward towards the rotatable shaft 303. As further upward force is applied the belling assembly 310 is pulled up through the hole until the base pan 309 can be accessed by the workers operating the belling auger 300. The belling auger 300 can either be removed entirely from the hole, or just raised near enough to the surface to afford access by the workers operating the belling auger 300. It's generally easier to raise the belling auger 300 out of the hole in order to shake the dirt out of the pan 309. In this way the workers can remove the dirt from the base pan 309, and if needed, lower the belling assembly 310 back into the hole for further belling operations. Typically, the belling auger 300 is raised and lowered for several rounds of belling operations since the dirt removed from the bottom of the hole is more than can be held by the base pan 309.

FIGS. 3A-C each show the belling auger 300 with shovel 301 in the retracted position. The portions of shovel 301 include: shovel cutting edge 301-1, shovel inner surface 301-2, and shovel outer surface 301-3. The shapes of the shovel cutting edge 301-1 and the shovel inner and outer surfaces 301-2 and 301-3 are important to the efficient operation of the belling auger 300. The shapes of these components are discussed in further detail below in conjunction with FIGS. 5 and 6A-C.

Figure 4:
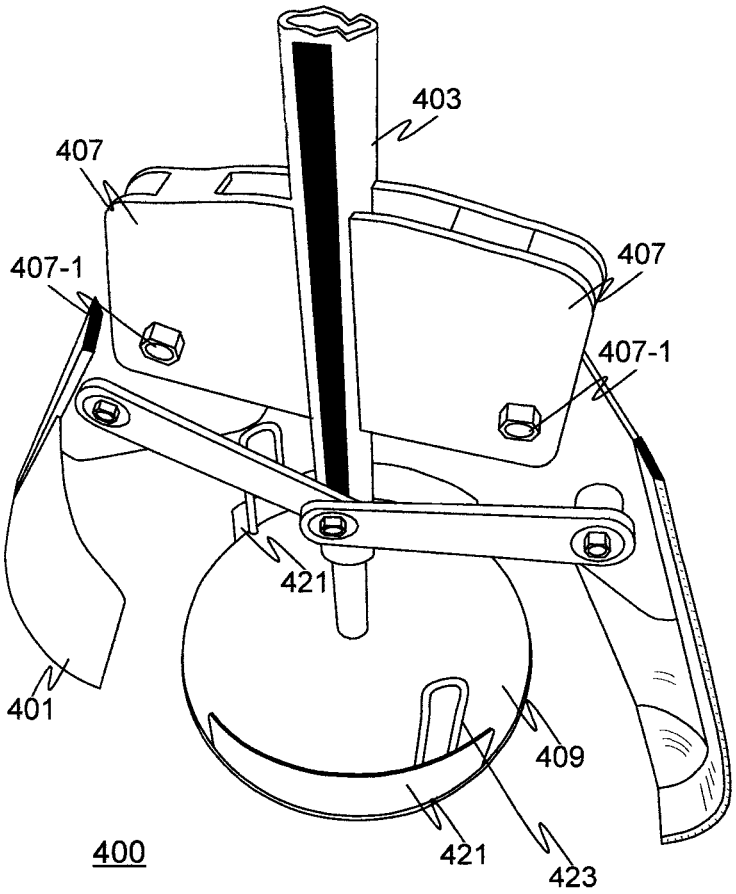
FIG. 4 depicts an oblique view of a belling auger with the shovels extended outward, according to various embodiments.

FIG. 4 depicts an oblique view of a belling auger 400 with the shovels extended outward, according to various embodiments. The belling auger 400 has sidewalls 421 which aid in keeping the dirt on the pan 409 as the belling auger 400 is raised to the surface. The sidewalls 421 extend upward from the level of base pan 409 and run partially around the base pan 409's edge. The sidewalls 421 are typically from 2 to 6 inches high. However, depending upon the size of the belling auger and the characteristics of the dirt, the sidewalls 421 may be as low as 1 inch to as his as 16 inches. The sidewalls 421 depicted in FIG. 4 are of uniform height. In some embodiments the sidewalls 421 may be of non-uniform height—they may be higher at one end than the other, or may be higher in the middle than the ends. In the embodiment of FIG. 4 a sidewall extension component 423 is affixed to each of the sidewalls 421.

The sidewalls 421 are positioned along the edge of the base pan 409, extending upward in the areas between the shovels 401 and 402 (e.g., from the front of one shovel 401 to the back of shovel 402). The sidewalls 421 do not extend upward in the area inward from the each of shovels 401/2 so as not to obstruct the dirt being thrown inward by the shovels. That is, the sidewalls 421 do not extend upward between the rotatable shaft 403 and the inner surface of shovel 401 or shovel 402. Further, for implementations of sidewalls 421 that extend upward higher than the shovel blades extend downward when in their retracted position, the shovels 401/2 will clear the sidewalls 421 as they move inwards towards the rotatable shaft 403. The shovels 401 hinge outward towards their extended position in response to downward force being applied to the rotatable shaft 403. Each shovel 401 is rotatably attached to its corresponding tab 407 by a bolt or pin which serves as the axis of rotation 407-1 for the shovel 401.

Figure 5:
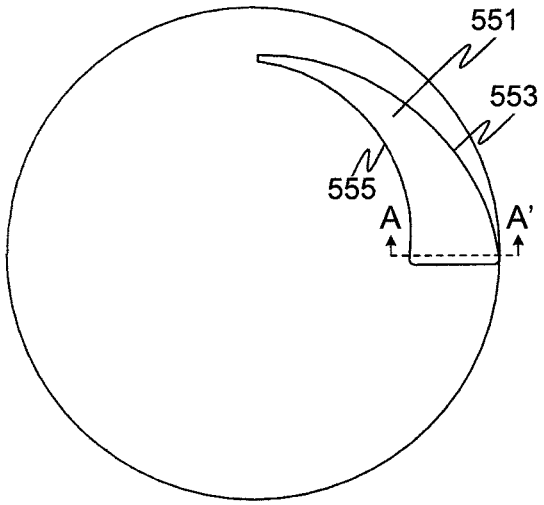
FIG. 5 depicts a cutaway top view of a belling auger showing the horizontal shovel curl, according to various embodiments.
Figure 6A:
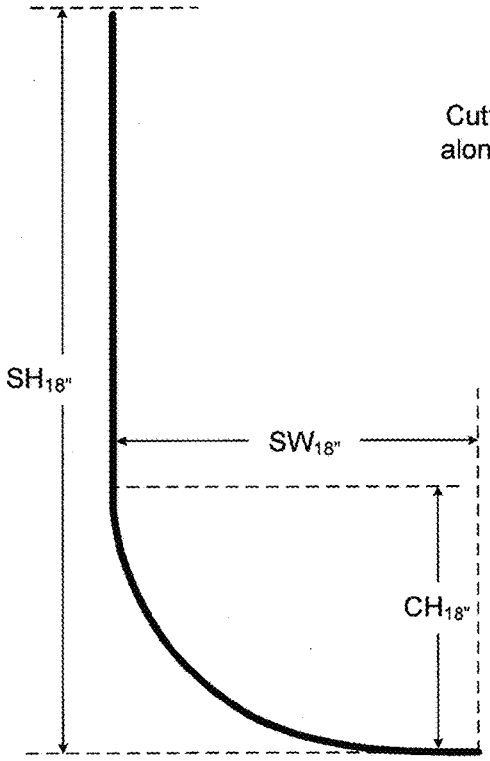
FIGS. 6A-C depicts cross-sectional edge views of belling augers taken along line A-A' of FIG. 5.
Figure 6B:
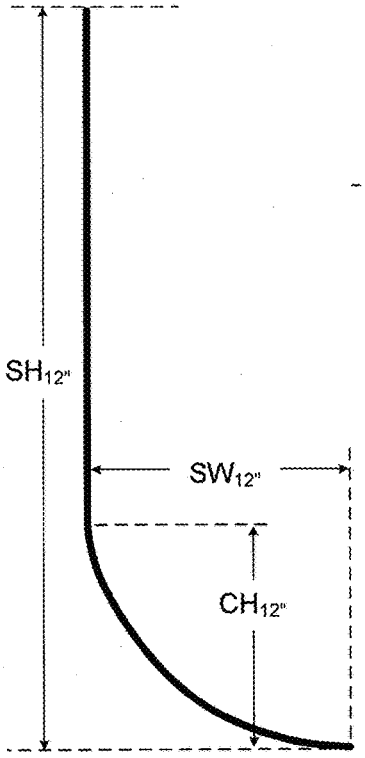
Figure 6C:
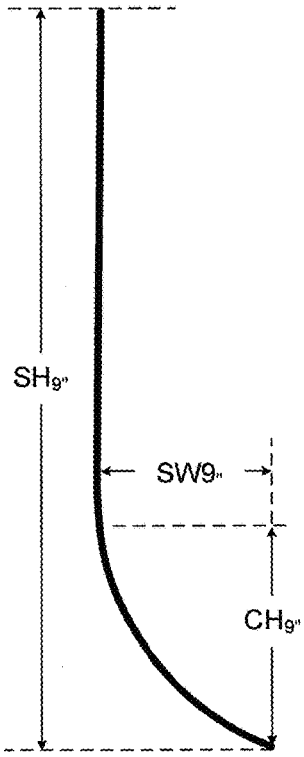

FIG. 5 depicts a cutaway top view of a belling auger showing the horizontal shovel curl, according to various embodiments. The top perspective, looking downward, of FIG. 5 shows the top edge shovel curve 555 and the bottom edge shovel curve 553. Since the bottom edge shovel curve 553 is a tighter curl than the top edge shovel curve 555, the cross-section of the shovel 555 appears to approximate a J shape. The J shaped cross-sections of the shovel taken between points A-A' are depicted in FIGS. 6A-C. The texture and stickiness of the soil, rotation speed, and other factors have an impact on the effectiveness of the horizontal shovel curve.

FIGS. 6A-C depict cross-sectional edge views of belling augers taken along line A-A' of FIG. 5. FIGS. 6A-C shows only the edge of the cross-section in order to emphasize the shovel cutting edge shape, and not the details of the shovel viewed past the cross-section. The cutting edge curve is also known as vertical shovel curve, according to various embodiments. Different shaped vertical shovel curves are more effective for different sized belling augers. The dimension $SH_{18}$ of FIG. 6A is the shovel height of the 18" belling auger. The dimension $SW_{18}$ is the shovel width of the 18" belling auger. The dimension $CH_{18}$ is the shovel curve (or curl) height of the 18" belling auger. FIGS. 6B-C are similarly labeled.

Figure 7:
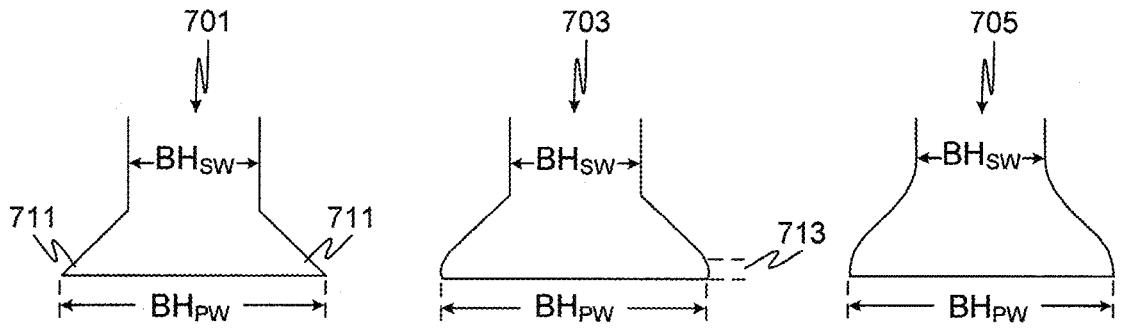
FIG. 7. depicts cross-sectional shapes of three belled piling holes, according to various embodiments.

FIG. 7 depicts cross-sectional shapes of three belled piling holes, according to various embodiments. Since the belling auger shovel has a rounded cutting edge curve and swings outward as it digs into the sidewall of the hole, it typically does not produce a hole such as hole 701 with a perfectly triangular shaped cross-section. Instead, the holes produced by the belling auger tend to have a more rounded contour as shown for holes 703 and 705. The belling hole pad width $BH_{PW}$ after a typical belling operation takes place tends to be around twice as wide as the belling hole shaft width $BH_{SW}$. This increased footprint aids considerably in supporting a structure such as a building or bridge as compared to conventional cylindrical piling holes.

In FIG. 7 the dimension $P_W$ is the pad width of the belled hole. The pad width $P_W$, and in particular the horizontal area covered by the pad, determines the amount of weight that the piling can support. The horizontal shape of the pads as seen from above (or below) is substantially round since the belled holes are created by a rotating tool that digs into the earth as it is rotated about an axis. The area of the pad is calculated using the equation: $\pi \times r^2$ (i.e., $pi \times r^2$ or approximately $3.1416 \times r^2$) where the variable "r" is the radius of the pad.

Figure 8A:
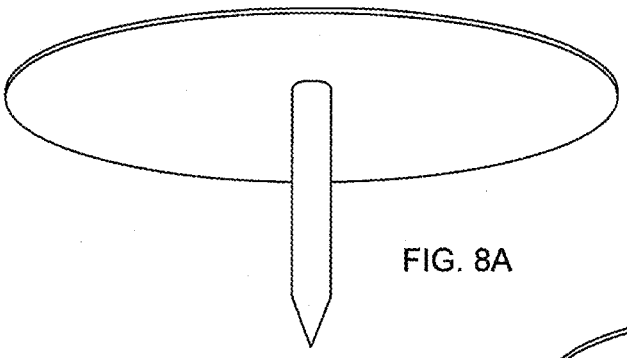
FIG. 8A depicts features for stabilizing a belling auger with a single stabilization spike, according to various embodiments.
Figure 8B:
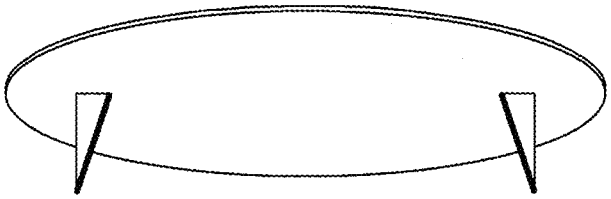
FIG. 8B depicts features for stabilizing a belling auger with dual stabilization spikes, according to various embodiments.

FIGS. 8A-B depict features for stabilizing a belling auger, according to various embodiments. The center stabilization spike shown in FIG. 8A is particularly useful to keep the bell auger centered in order to efficiently and smoothly carve away at the sidewalls of the hole. The center stabilization spike of FIG. 8A may be used on belling augers designed to have the base pan rotate along with the belling assembly (e.g., base pan 309 and belling assembly 310 of FIG. 3A). The length of the center stabilization spike tends to be approximately 50% of the diameter of the belling hole at its widest point—that is, approximately the width of the hole shaft; e.g., belled hole shaft width $BH_{SW}$ of FIG. 7. In some embodiments the center stabilization spike may be 50% of the $BH_{SW}$ or greater. In other embodiments the center stabilization spike may be 65% of the $BH_{SW}$ or greater, while in other embodiments it may be 75% of the $BH_{SW}$ or greater, or even 85% of the $BH_{SW}$ or greater.

The larger sized bell augers—e.g., 24" and greater—can require a great deal of rotational torque to rotate the base pan as it is being pressed downward. Therefore, some embodiments of the larger sized belling augers are designed to operate with a stationary base plate. The base plate on these embodiments is equipped with bearings and is free to rotate independent from the rest of the belling auger assembly. In this way the base plate stays stationary with respect to the ground as the belling auger assembly rotates around it. Some embodiments with a stationary base pan may use multiple stabilization spikes as shown in FIG. 8B. For example, dual 6" stabilization spikes may be adequate for a 12" or 16" bell auger. But in loose or muddy dirt a 6" stabilization spike may not be long enough to keep a 24" (or larger) bell auger centered during operation. Multiple 9" or even a 12" stabilization spikes provide considerably more horizontal stability. Various embodiments may use three or more stabilization spikes, or a stabilization spikes of various lengths from 6" up to 24". Extremely large bell augers, or bell augers operating is special conditions (e.g., a muddy river bottom) may utilize stabilization spikes even longer than 24".

Figure 9A:
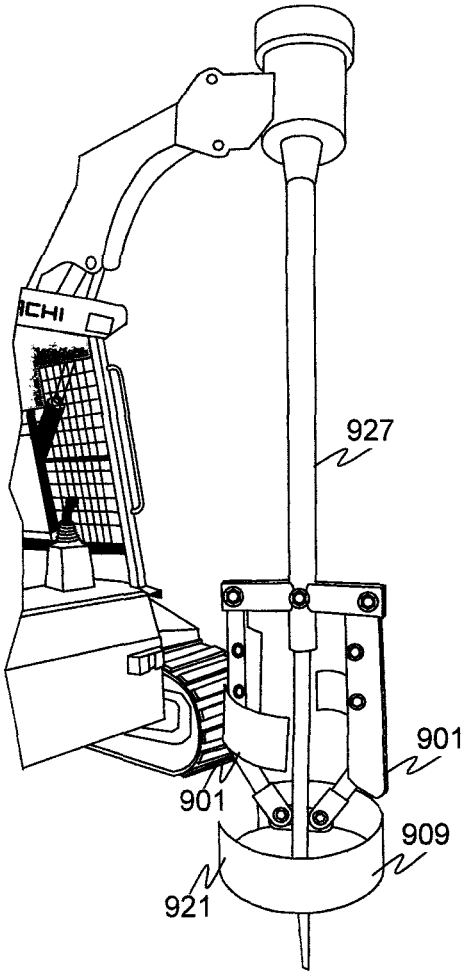
FIGS. 9A-B depicts oblique views of a belling auger in an extended position and a retracted position, according to various embodiments.
Figure 9B:
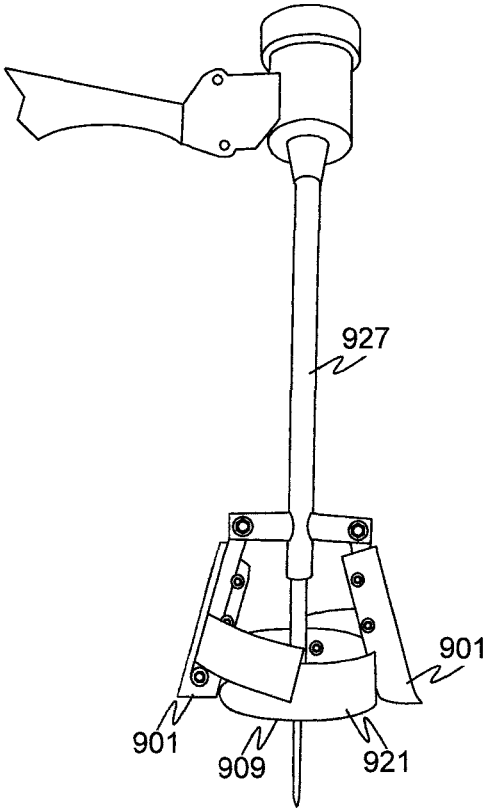

FIGS. 9A-B depicts oblique views of a belling auger in an extended position and a retracted position, according to various embodiments. The belling auger of FIGS. 9A-B differs from the smaller sized belling auger of FIGS. 3A-C inasmuch as the FIGS. 9A-B has a higher side panel 921. FIG. 9A depicts the belling auger in the retracted position with its shovels retracted inwards towards the rotatable shaft 927. FIG. 9B depicts the belling auger in the extended position with its shovels extended outward. Comparing FIG. 9B to FIG. 9AB it can be seen that rotatable shaft 927 has slid downward with respect to the base pan 909. In FIG. 9A, which shows belling auger in the retracted position, the rotatable shaft 927 is several inches away from sliding sleeve 919. In FIG. 9B, which shows belling auger in the extended position, the rotatable shaft 927 is pressed downward towards the base pan 909. Pressing rotatable shaft 927 downward activates the belling auger's folding mechanism, causing the shovels 901 to hinge outward.

Figure 10A:
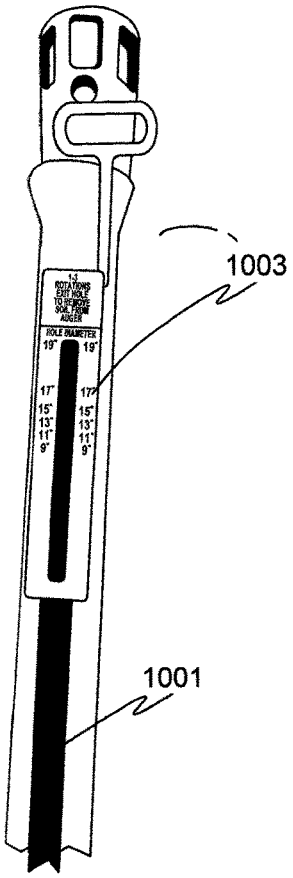
FIGS. 10A-D, depict a belling gauge for taking measurements during the belling process, according to various embodiments.
Figure 10D:
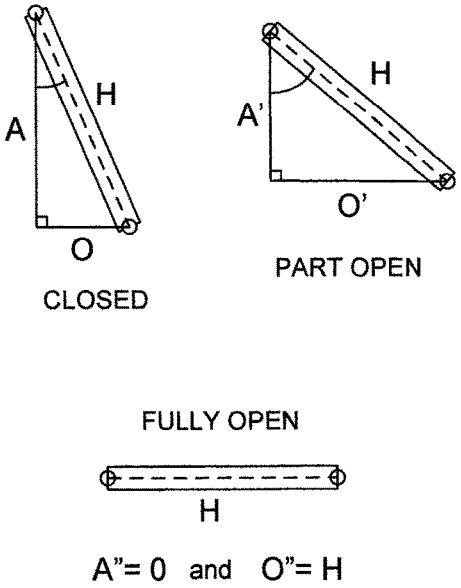
Figure 10B:
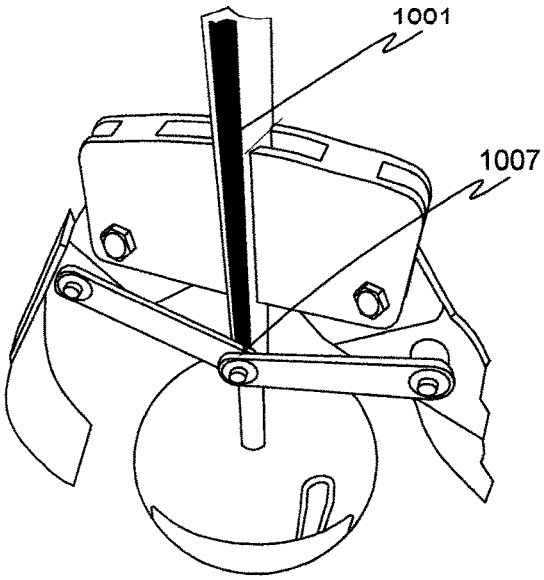
Figure 10C:
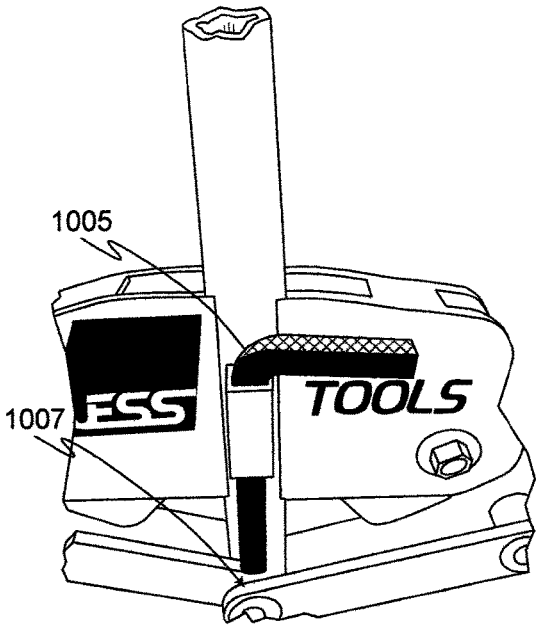

FIGS. 10A-C, depict a belling gauge for taking measurements of the belling hole width during the belling process, according to various embodiments. It is useful to know how far the shovels have cut into the sides of the shaft hole in order to determine the width of the belling hole. Such measurements can be made using the gauge rod 1001 and graduated measurement scale 1003 shown in FIG. 10A. The hole width measurement is made by taking a reading with the pan sitting on the shaft hole bottom with the shovels in their inward position, and then taking another reading with the shovels splayed outward as the bell auger digs into the sides of the shaft hole. The inner strap pivot point one spot where the measurement can be taken—e.g., inner strap pivot point 305-1 of FIG. 3A. As a practical matter the measurement is taken from the top of the inner strap at point 1007 depicted in FIGS. 10B-C. FIG. 10B depicts the gauge rod 1001 sitting on the top of the inner strap at point 1007.

In another embodiment a movable measurement platform 1005 is provided to take the measurement from. With the belling auger down towards the bottom of a hole it can sometimes be difficult to ensure that the gauge rod 1001 is sitting on the inner strap at point 1007 for the correct measurement to be taken. If the gauge rod 1001 slips off its perch it may end up sitting on the bolt at the inner strap's axis of rotation, or gauge rod 1001 could have a dirt clod wedged underneath it—both of which situations give rise to an erroneous reading. In the embodiment depicted in FIG. 10C that prevents such problems the measurement platform 1005 passes through a guide to keep it in place and rides up and down on the top of the inner strap at point 1007. The measurement is taken from the top of the measurement platform 1005.

The difference between the two readings is mathematically related to distance the shovels swing outward. This is illustrated in FIG. 10D with depicts three representations of the belling auger, namely, "CLOSED", "PART OPEN" and "FULLY OPEN". With the belling auger pan sitting on the floor of the hole, and the belling auger in the closed position, the inner strap (e.g., inner strap 305 of FIG. 3A) is angled outward slightly. The inner strap should be angled outward somewhat in order for the shovels to spread out in response to a downward force being applied. The first reading is taken with the shovels in the "CLOSED" position as shown in the FIG. 10D. The vertical distance between the two ends of the inner strap is measured at the variable A (e.g., A=adjacent). The length of the inner strap is a fixed value H (e.g., H=hypotenuse). The opposite side of the right triangle formed with adjacent side A and hypotenuse H is the variable O (e.g., O=opposite). The variable H is fixed, and the variable A is measured. Since it is desired to find out the width of the belling hole the value of the opposite side O must be solved for. Since we have a right triangle the variable O is defined by the following equation:

Belling Hole Pad Width Calculation: $O=(H^2-A2)^{1/2}$

In the initial position with the shovels fully closed (labeled "CLOSED" on FIG. 10D) the variable A is at its maximum value and the variable O is at its minimum value. At a partially extended position (labeled "PART OPEN") the variable A' is smaller than the initial value of A, and the variable O' is larger than the initial value of O. The value of hypotenuse H remains fixed throughout the measurements. At the fully extended position (labeled "FULLY OPEN") the variable A" is at zero with the inner strap being horizontal, and the variable O" is equal to the variable H. (Note: O" represents the variable O" not zero (i.e., not O) in FIG. 10D which depicts O"=H.) It should be noted that the variable O (along with O' and O") does not directly measure the width of the belling hole radius since the shovels extend beyond the end of the inner strap which defines the end of the length of variable O. However, O, O' and O" have a linear relationship with the bell hole radius. A scaling factor must be used to determine the bell hole radius and bell hole width. The scaling factor depends upon the dimensions of the particular embodiment being used, and can easily be determined through a few simple measurements.

Rather than require use of an equation at the jobsite a table of values is typically prepared and provided with the belling auger. One useful format is to provide a measure of how wide the belling hole is based on 0.5 inch increments of change in the variable O, that is, the vertical measurement. For example, in at least one embodiment for each addition 0.5 inch the bell auger assembly is pressed downward (the O variable) the shovels unfold outward by 2 inches in the horizontal direction.

Figure 11:
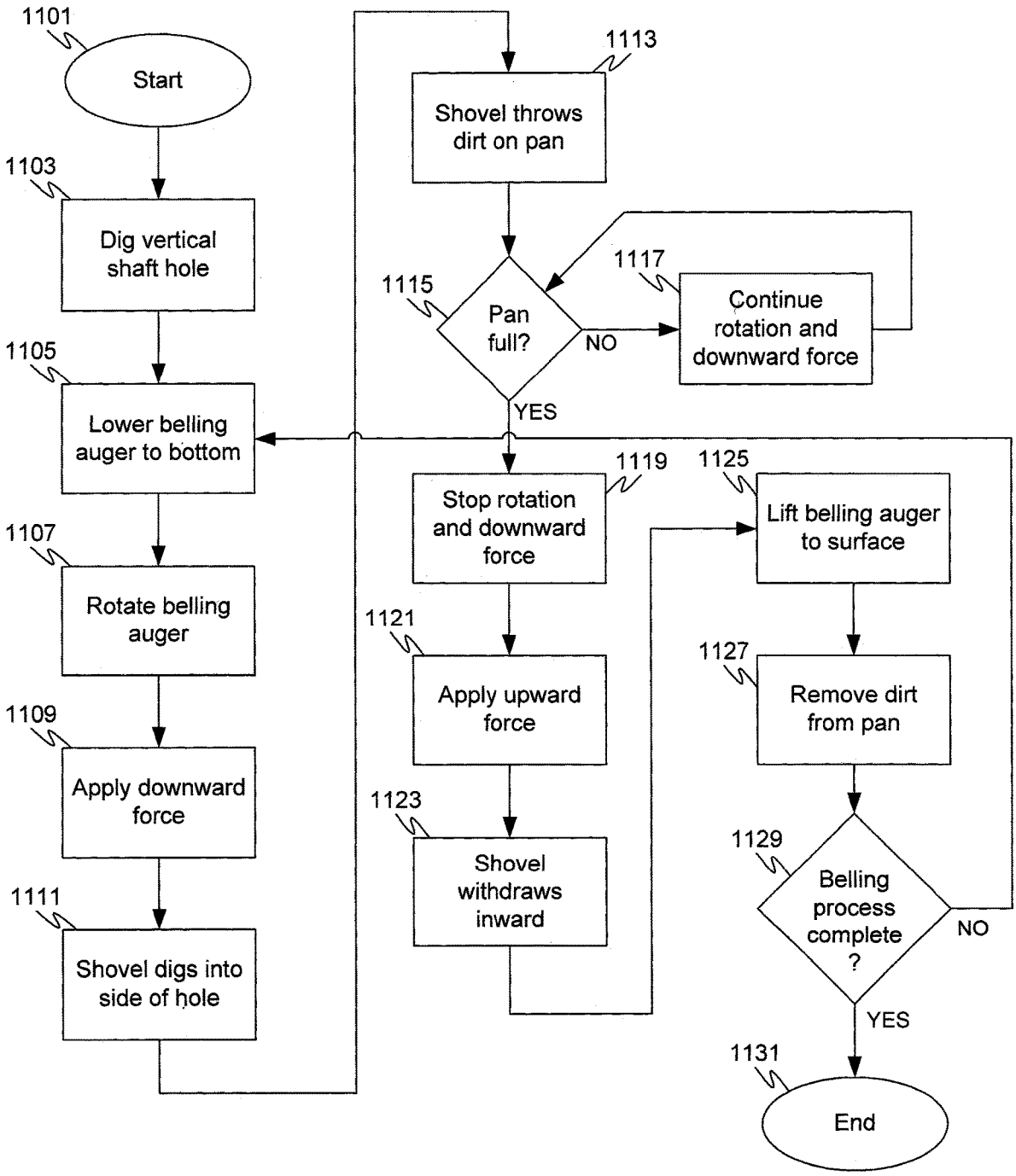
FIG. 11 is a flowchart of a method of belling a hole with a belling auger, according to various embodiments.

FIG. 11 is a flowchart of a method of belling a hole with a belling auger, according to various embodiments. The method begins at block 1101 and proceeds to 1103 where the vertical shaft is dug. The vertical shaft is typically dug to the desired depth for the pad, for example, using an auger specially designed to dig holes in the earth. Upon completion of the vertical shaft the digging auger is removed from the hole and the method proceeds to block 1105 to begin the belling process.

In block 1105 the belling auger is lowered to the bottom of the vertical shaft, and the method proceeds to block 1107. With the belling auger pan sitting on the bottom of the vertical shaft the user activates the source of rotational force to begin rotating the belling auger, and the method proceeds to block 1109. In block 1109 a downward force is applied to the belling auger. The downward force varies, depending upon the characteristics of the soil and size of the belling auger being used. The downward force may be as little as 100 pounds to as much as 1,500 pounds or more. The belling auger itself with the vertical shaft typically weighs around 275 pounds. So in some instances little no additional downward force is required. A typical downward force is in the range of from 100 to 500 pounds in addition to the weight of the belling auger itself. It is useful for the source of applying the downward force (e.g., the skid steer) to be able to vary the amount of downward force to match the conditions of the soil and other variables. In block 1111 in response to applying downward force while the belling is rotating, the shovels of the belling auger begin to spread apart, digging into the sides of the hole shaft to widen it out. In block 1113 the shovels throw the loosened dirt onto the pan.

The method proceeds to block 1115 where it is determined whether or not the pan is full of dirt. Typically, the pan fills us with approximately three revolutions of the belling auger. If the bottom of the hole shaft being belled isn't too deep the user can sometimes see down to the pan to determine whether or not it's full. If the pan isn't visible it is prudent to assume the pan is full enough at three revolutions of the device. If the pan gets too full it could prevent the shovels from folding inward completely and damage the sides of the hold as the belling auger is raised to the surface. If it is determined in block 1115 that the pan is not yet full the method proceeds along the "NO" path to block 1117 to continue rotating the belling auger and applying downward force. From block 1117 the method loops back to block 1115. If it is determined in block 1115 that the pan is sufficiently full the method proceeds along the "YES" path to block 1119 to stop the rotation and downward pressure. Upon halting the rotation and downward pressure the method proceeds to block 1121.

In block 1121 an upward force is applied to the bell auger. In response to applying the upward force the shovels retract to their inward position, and the bell auger is raised to the surface in block 1125. The method proceeds to block 1127 to remove the dirt from the pan, and then proceeds to block 1129 to determine whether further belling is needed. The user can tell how wide the pad has been belled (i.e., widened) through use of the measurement tool described in FIGS. 10A-D. Another indication of how much dirt has been removed during the belling process is the amount of dirt removed after the belling auger is lifted to the surface. If a bushel of dirt has been removed from the pan then amount of belling (i.e., widening) at the bottom of the hole shaft has removed approximately a bushel of dirt. If it is determined that further belling is required the method proceed from block 1129 along the "NO" path back to block 1105 to lower the belling auger into the hole shaft again for further belling operations. However, if it is determined in block 1129 that the belling process is complete the method proceeds to block 1131 and ends.

The terminology used herein describes the embodiments outlined in this specification, and is not intended to limit the invention. The terms "up" or "upward" refer to a direction tending away from the center of the earth. The terms "directly up" or "directly upward" refer to the direction straight upward away from the center of the earth. The phrases "removably attached", "removably affixed" or "removably mounted", as used herein, mean a part (or mechanism, component device, unit etc.) that can be attached to another part, and later removed without destroying or damaging either part or the mechanism for removably attaching the two pieces. For example, a threaded nut is removably attachable to a bolt. A king bolt is removably attachable to a wagon tongue. However, one piece of metal welded onto another piece of metal is not removably attached. Also, one part that is riveted onto another part is not considered to be removably attached since the rivets must be destroyed to separate the two parts. Two parts that are "permanently attached" or "permanently affixed", as used herein, are attached in a manner that is not conducive to separating the parts without damaging one part or the other, or damaging the means of attaching them together. Two parts may be "permanently attached" (or "permanently affixed"), for example, by being welded, glued or riveted together. Further two parts that are formed from the same piece of material are considered to be permanently attached together. The phrase "threaded attachment mechanism" as used herein is defined to mean a bolt, a machine screw, a screw, a threaded rod, or other like type of elongated part with threads configured to be screwed into a threaded hole or other hole as are known by those of ordinary skill in the art. "Cutting" a hole in a piece of material (e.g., a panel) can be achieved by drilling, sawing, melting with a blow torch, cutting with a laser or otherwise removing some material from the piece of material so as to create a hole.

The phrase "rotationally attached" means that the two parts are attached to each other but can rotate with respect to each other. A car wheel is rotationally attached to a car. A circular saw has a saw blade rotationally attached to it. One component is "fixed in position with respect to" a second component if the two components do not move with respect to each other. The horn of an anvil is fixed in position with respect to the hardie hole of the anvil. A stop sign is fixed in position with respect to the post holding it up. Two components are "rigidly affixed" to each other if, during the normal course of their use they remain fixed in position with respect to each other. A stop sign is rigidly affixed to the post holding it up. While it may be possible that wind could cause the stop sign to blow off its post, or a person could unscrew the bolts holding the stop sign on it post, these two activities are beyond the realm of normal use for the stop sign.

The phrase "proximate" refers to a component's location relative to another item. For example, a shaft proximate another item means that the shaft is either on a part mounted on the item or else the shaft is mounted on the item itself. "Proximate" can also mean within a distance of no greater than one-half the largest dimension of the thing itself. For example, a one-inch long part is proximate another item if it is within no more than one-half inch from the item. The "extended position" of the shovels is the position where they are extended as far out as possible. Belling a hole out to the extended position provides the widest possible pad for the belling auger being used. The "retracted position" is the position with the shovels fully retracted inward as far as they will go. The belling auger is pulled up through the belling hole shaft carrying a loaded base pan of dirt with the shovels in their retracted position. The phrase "belling a hole" means to widen a hole at the bottom of the hole. The "distal end" is the end furthest from the center of a body. The "proximal end" is the end nearest the center of a body. A person's hands are at the distal ends of their arms while their shoulders are at the proximal ends of their arms. The tip of shovel 301 of FIG. 3A is at the shovel's distal end.

As used herein, the singular forms "a", "an" and "the" are intended to include the plural forms as well, unless the context clearly indicates otherwise. It will be further understood that the terms "comprises," "comprising," "includes," and/or "including" used in this specification, including the claims, specify the presence of stated features, integers, steps, operations, elements, and/or components, but do not preclude the presence or addition of one or more other features, integers, steps, operations, elements, components, and/or groups thereof. The terms "obtaining" or "providing", as used herein and in the claims, means to retrieve an article or device to be assembled as part of the apparatus at issue. Further, the terms "obtaining" or "providing" may be defined to mean fabricating, or adapting another part to operate as the article or device. For example, bending up the ends of a bottom panel to form side panels can be interpreted as providing side panels attached to a bottom panel. The term "plurality", as used herein and in the claims, means two or more of a named element. It should not, however, be interpreted to necessarily refer to every instance of the named element in the entire device. Particularly, if there is a reference to "each" element of a "plurality" of elements. There may be additional elements in the entire device that are not included in the "plurality" and are therefore, not referred to by "each." The belling augers are discussed herein in terms of being measured in inches; e.g., 18" belling auger is a belling auger that bells out an 18 inch wide hole. However, the belling augers could be described in terms of other units of measurement; e.g. centimeters or the like.

The corresponding structures, materials, acts, and equivalents of any means plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope or gist of the invention. The various embodiments included for discussion herein were chosen and described in order to best explain the principles of the invention and the practical application, and to enable others of ordinary skill in the art to understand the invention for various embodiments with various modifications as are suited to the particular use contemplated.

The invention claimed is:

1. A belling auger apparatus for belling a hole in earth, the apparatus comprising:

a base pan;

a base shaft rigidly affixed to a center point of the base pan;

an extension strap rotatably connected at a first pivot point to the base shaft;

a rotatable shaft with a lower end; and a shovel with a distal end and a proximal end rotatably connected at a second pivot point to the rotatable shaft, the shovel being rotatably connected to the extension strap at a third pivot point located between the second pivot point and the distal end;

wherein the shovel rotates about the second pivot point away from the base shaft in response to a downward force being applied to the rotatable shaft; and wherein the shovel rotates around the base shaft in response to a rotational force being applied to the rotatable shaft.

2. The apparatus of claim 1, wherein the base shaft is rigidly affixed to a top side of the base pan, the apparatus further comprising:

a stabilization spike rigidly affixed to a bottom side of the base pan;

wherein the downward force applied to the rotatable shaft moves the lower end of the rotatable shaft towards the base pan.

3. The apparatus of claim 2, wherein the downward force is at least 100 pounds.

4. The apparatus of claim 3, wherein a combined weight of the base pan and the base shaft is at least 15 pounds.

5. The apparatus of claim 3, wherein the rotational force is at least 100 foot-pounds.

6. The apparatus of claim 5, wherein the shovel digs into a side of the hole in response to rotating about the second pivot point away from the base shaft.

7. The apparatus of claim 6, wherein the shovel throws dirt from the side of the hole into the base pan in response to rotating about the second pivot point away from the base shaft and in response to rotating around the base shaft.

8. The apparatus of claim 7, wherein the downward force is at least 200 pounds;

wherein the rotational force is at least 200 foot-pounds; and wherein a combined weight of the base pan and the base shaft is at least 25 pounds.

9. A method of belling an earth hole using a belling auger apparatus, the method comprising:

providing a base pan;

rigidly affixing a base shaft rigidly to a center point of the base pan;

rotatably connecting an extension strap at a first pivot point to the base shaft;

providing a rotatable shaft with a lower end;

rotatably connecting a shovel with a distal end and a proximal end at a second pivot point to the rotatable shaft, the shovel being rotatably connected to the extension strap at a third pivot point located between the second pivot point and the distal end;

applying a downward force to the rotatable shaft; and rotating the shovel about the second pivot point away from the base shaft in response to the downward force being applied to the rotatable shaft;

wherein the shovel rotates around the base shaft in response to a rotational force being applied to the rotatable shaft.

10. The method of claim 9, wherein the base shaft is rigidly affixed to a top side of the base pan, the apparatus further comprising:

rigidly affixing a stabilization spike to a bottom side of the base pan;

wherein the downward force applied to the rotatable shaft moves the lower end of the rotatable shaft towards the base pan.

11. The method of claim 10, wherein the downward force is at least 100 pounds.

12. The method of claim 11, wherein a combined weight of the base pan and the base shaft is at least 15 pounds.

13. The method of claim 12, wherein the rotational force is at least 100 foot-pounds.

14. The method of claim 13, further comprising:

digging the shovel into a side of the hole in response to rotating about the second pivot point away from the base shaft.

15. The method of claim 14, further comprising:

the shovel throwing dirt from the side of the hole into the base pan in response to rotating about the second pivot point away from the base shaft and in response to rotating around the base shaft.

16. The method of claim 6, wherein the downward force is at least 200 pounds;

wherein the rotational force is at least 200 foot-pounds; and wherein a combined weight of the base pan and the base shaft is at least 25 pounds.

* * * * *